US010456331B2

(12) United States Patent
Gamberini

(10) Patent No.: US 10,456,331 B2
(45) Date of Patent: Oct. 29, 2019

(54) FEEDING ASSEMBLY TO FILL CAPSULES WITH GRANULES, IN PARTICULAR MICROGRANULES

(71) Applicant: MG2-S.R.L.

(72) Inventor: Ernesto Gamberini, Rastignano (IT)

(73) Assignee: MG 2-S.R.L., Lovalita Pian di Macina (IT)

( * ) Notice: Subject to any disclaimer, the term of this patent is extended or adjusted under 35 U.S.C. 154(b) by 222 days.

(21) Appl. No.: 15/583,507

(22) Filed: May 1, 2017

(65) Prior Publication Data

US 2017/0312179 A1 Nov. 2, 2017

(30) Foreign Application Priority Data

May 2, 2016 (IT) ..... 102016000044748

(51) Int. Cl.

| | |
|---|---|
| ***A61J 3/07*** | (2006.01) |
| ***B65B 7/28*** | (2006.01) |
| ***B65B 3/04*** | (2006.01) |
| ***B65B 3/28*** | (2006.01) |

(52) U.S. Cl.

CPC ..... *A61J 3/074* (2013.01); *B65B 3/04* (2013.01); *B65B 3/28* (2013.01); *B65B 7/28* (2013.01)

(58) Field of Classification Search

CPC .... B65B 1/10; B65B 1/12; B65B 1/14; B65B 1/16; B65B 1/32; B65B 3/04; B65B 3/06; B65B 3/08; B65B 3/28; A61J 3/074; G01G 17/00

See application file for complete search history.

(56) References Cited

U.S. PATENT DOCUMENTS

| | | | | |
|---|---|---|---|---|
| 7,694,497 | B2 * | 4/2010 | Tagliavini | A61J 3/074 53/452 |
| 9,642,812 | B2 * | 5/2017 | Penachio | A61K 31/198 |
| 2005/0217752 | A1 | 10/2005 | Facchini | |
| 2006/0064943 | A1 | 3/2006 | Trebbi | |
| 2015/0204714 | A1 * | 7/2015 | Boehringer | A61J 3/074 53/281 |
| 2016/0067704 | A1 * | 3/2016 | Nitsch | G01F 11/10 73/864.11 |

FOREIGN PATENT DOCUMENTS

| | | |
|---|---|---|
| EP | 2949309 | 12/2015 |
| WO | 0170171 | 9/2001 |

OTHER PUBLICATIONS

Italian Search Report for Corresponding Applicaton No. ITUA 2016 3077.

* cited by examiner

*Primary Examiner* — Marina A Tietjen

(74) *Attorney, Agent, or Firm* — Gottlieb, Rockman & Reisman, P.C.

(57) ABSTRACT

A feeding assembly to fill capsules with granules, in particular microgranules, has a filling drum, which is provided with a plurality of fillers, each defined by a respective suction pipe, which can be connected to a pneumatic sucking device and has a lower end to pick up/release the granules; the lower end of each suction pipe being closed by a closing element provided with a plurality of openings, each designed so as to prevent the granules from getting into the suction pipe.

20 Claims, 4 Drawing Sheets

FEEDING ASSEMBLY TO FILL CAPSULES WITH GRANULES, IN PARTICULAR MICROGRANULES

PRIORITY CLAIM

This application claims priority from Italian Patent Application No. 102016000044748 filed on May 2, 2016, the disclosure of which is incorporated by reference.

TECHNICAL FIELD

The invention relates to a feeding assembly to fill capsules with granules, in particular microgranules.

BACKGROUND OF THE INVENTION

When dealing with the filling of capsules with pharmaceutical products in granules, a feeding assembly is known, which is of the type comprising a filling drum, which is mounted so as to rotate around a given rotation axis and is provided with a plurality of fillers distributed around the rotation axis; and a pocket conveyor, which is provided with a plurality of pockets, each designed to receive and hold a bottom of a respective capsule.

The granules are housed inside an annular containing hopper, which has a longitudinal axis, which is parallel to and distinct from the aforesaid rotation axis of the filling drum.

Each filler comprises a suction pipe, which can be connected to a pneumatic sucking device and is coupled to the filling drum so as to carry out, relative to the filling drum, straight movements parallel to the rotation axis.

Each suction pipe is provided with a thin plate, which is fixed in an intermediate point of the suction pipe, so as to define a lower filling chamber, whose volume depends on the position of the thin plate along the suction pipe.

The thin plate has a plurality of openings, which allow the filling chamber to be connected to the pneumatic sucking device and are designed so as to prevent the granules from moving forward along the suction pipe.

The suction pipes are fed by the filling drum along an annular path, which extends around the aforesaid rotation axis and comprises a first portion overlapping the hopper and a second portion on the outside of the hopper.

In the area of the first portion, each suction pipe is firstly lowered into the hopper so as to suck a corresponding quantity of granules into the filling chamber and is then lifted to disengage the hopper.

In the area of the second portion, each suction pipe is lowered on the relative bottom so as to release the granules contained in the filling chamber into the bottom.

Since, at the outlet of the hopper, each feeding pipe holds back a quantity of granules that is greater than the volume of the relative filling chamber, the granules projecting out of the filling chamber must be scraped by means of a scraper and recirculated again inside the hopper.

The presence of the scraper and of the granule recirculation system in the hopper makes known feeding assemblies of the type described above relatively complicated and expensive.

Furthermore, the scraping process can jeopardize the integrity of the excess granules of each suction pipe and, in any case, leads to the recirculation and the handling of relatively large quantities of granules on the outside of the hopper.

SUMMARY OF THE INVENTION

The object of the invention is to provide a feeding assembly to fill capsules with granules, in particular microgranules, which is designed to eliminate the aforementioned drawbacks in a straightforward, relatively low-cost manner.

According to the invention, there is provided a feeding assembly to fill capsules with granules, in particular microgranules, according to the appended claims.

BRIEF DESCRIPTION OF THE DRAWINGS

The invention will now be described with reference to the accompanying drawings, which show a non-limiting embodiment thereof, wherein.

DETAILED DESCRIPTION OF THE INVENTION

Figure 1:
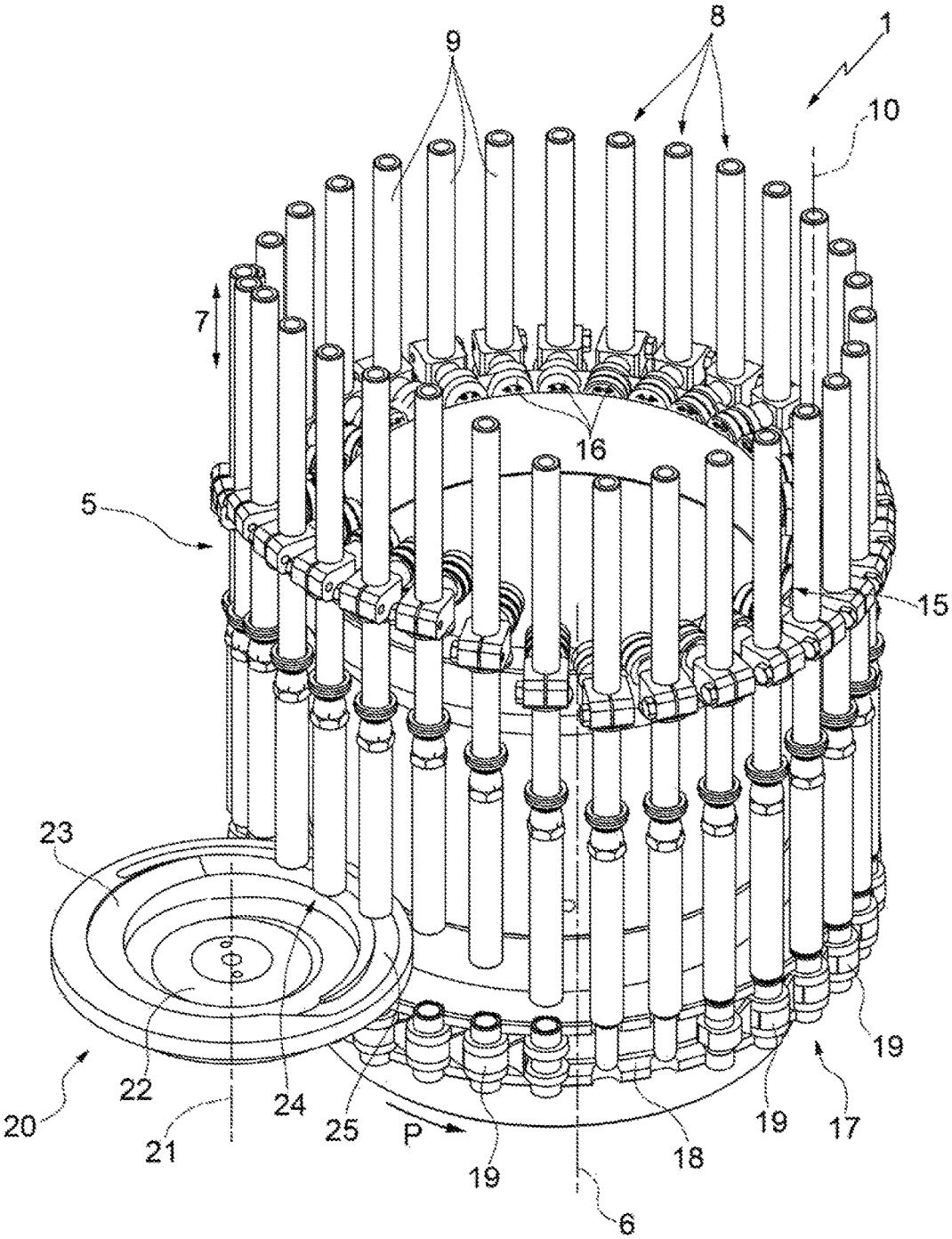
FIG. 1 is a schematic perspective view, with parts removed for greater clarity, of a preferred embodiment of the feeding assembly according to the invention.
Figure 3:
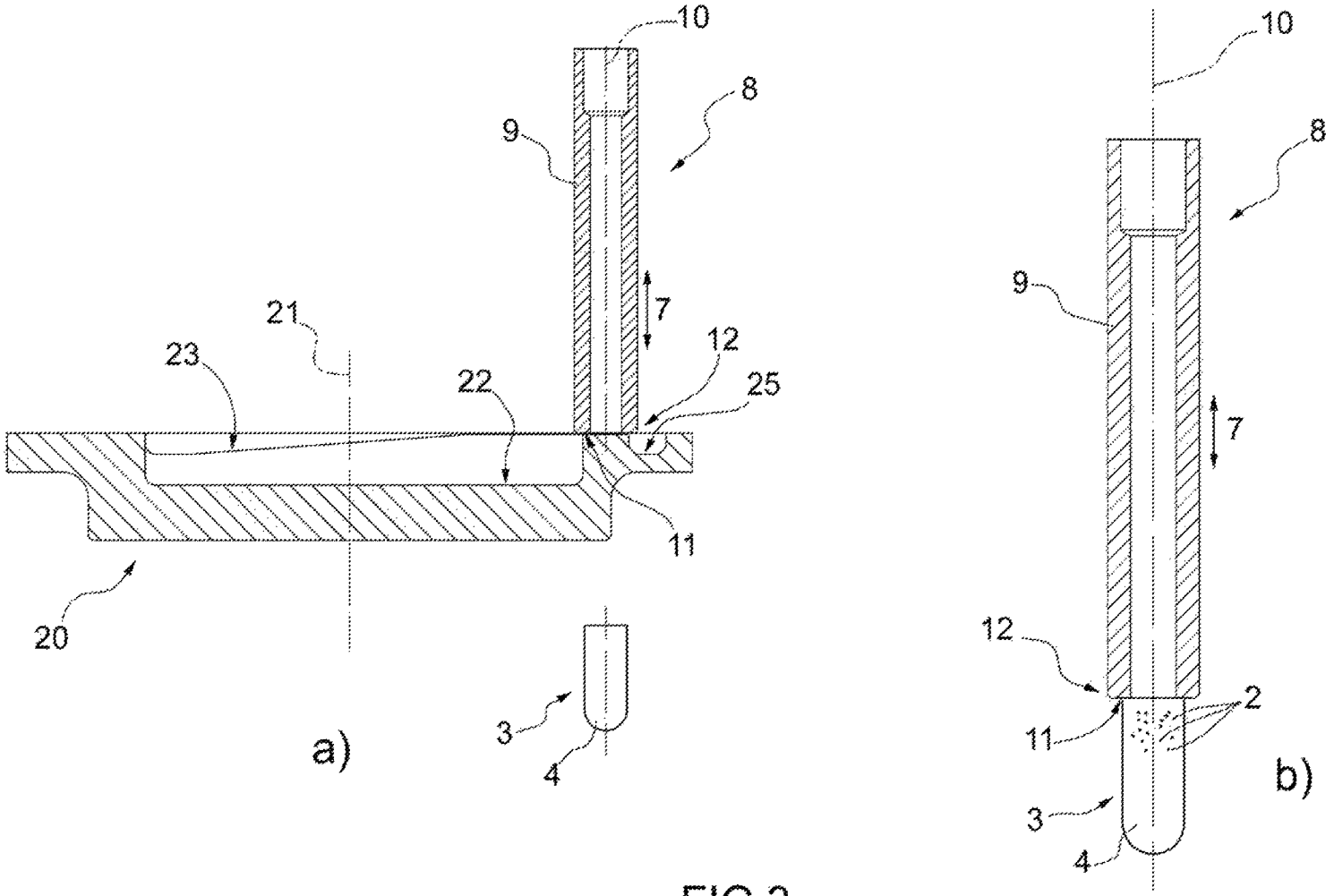
FIG. 3 is a schematic side view, with cross-sectional parts and parts removed for greater clarity, of the feeding assembly of FIG. 1 shown in two different operating positions.

With reference to FIGS. 1 and 3, number 1 indicates, as a whole, a feeding assembly to fill capsules 3 with granules 2, in particular microgranules of pharmaceutical products, each capsule 3 comprising a bottom 4, which is substantially cup-shaped, and a closing lid (not shown) for the bottom.

The feeding assembly defines part of a machine to fill capsules 3 and comprises a filling drum 5, which is mounted so as to rotate in a continuous manner around a rotation axis 6, which is substantially parallel to a vertical direction 7.

The drum 5 supports a plurality of fillers 8, which are uniformly distributed around the axis 6 and are fitted on an outer side wall of the drum 5.

Figure 2:
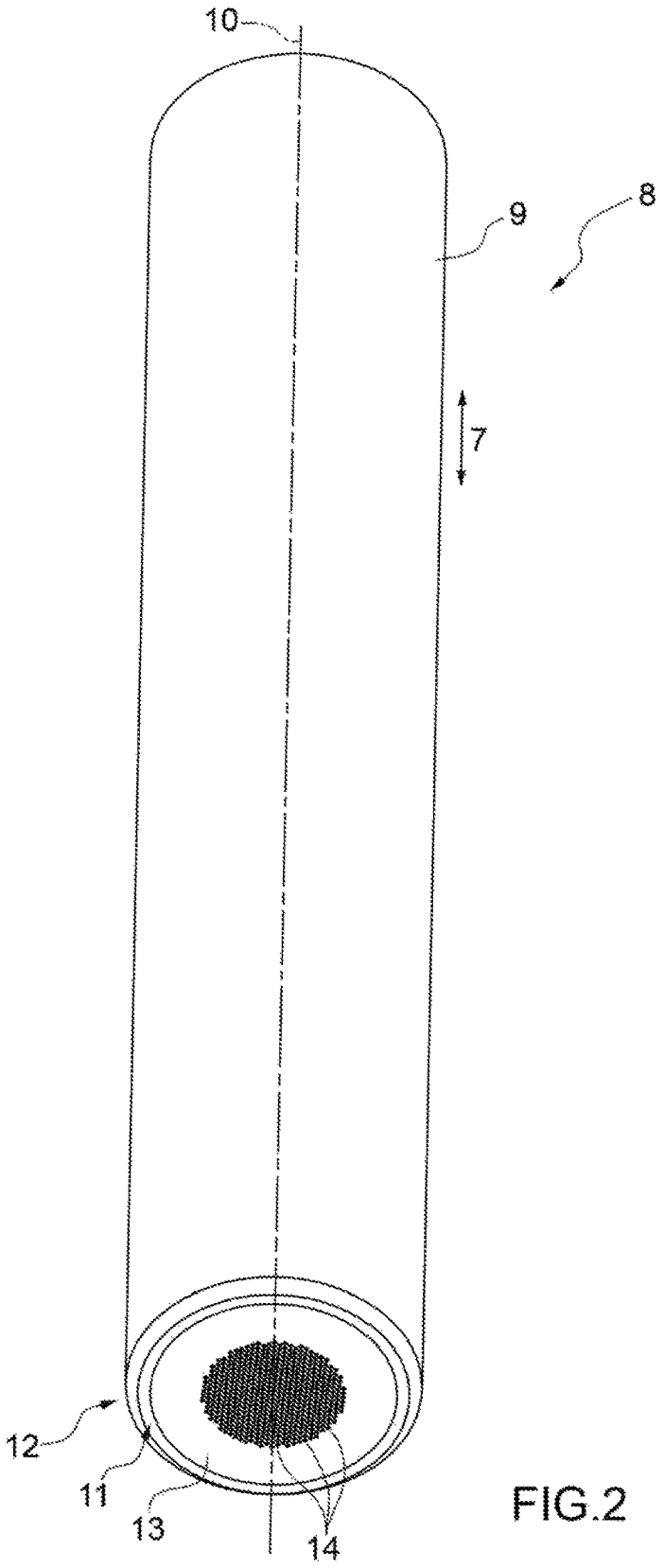
FIG. 2 is a schematic perspective view of a detail of the feeding assembly of FIG. 1.

According to FIGS. 1 and 2, each filler 8 comprises a suction pipe 9, which has a longitudinal axis 10 parallel to the direction 7 and is axially delimited by a lower annular face 11 substantially perpendicular to the direction 7.

The pipe 9 has a lower end 12, which is closed, in particular, by a flat thin plate 13, which is fixed to the face 11 perpendicularly to the direction 7.

The thin plate 13 has a plurality of openings 14, which are designed to as to prevent the granules 2 from getting into the pipe 9 and are distributed inside an area with a circular shape.

According to a variant that is not shown herein, the openings 14 are distributed inside an area with an elongated shape.

The pipes 9 can be connected to a pneumatic sucking device (not shown) and are coupled to the drum 5 in a sliding manner so as to carry out, relative to the drum 5, straight movements in the direction 7 under the thrust of a cam operating device 15 comprising, for each filler 8, a respective cam follower 16, which is mounted so as to rotate on the relative pipe 9 and is engaged in an annular cam (not shown) substantially coaxial to the axis 6.

The bottoms 4 are fed around the axis 6, each in phase with a respective filler 8, by a pocket conveyor 17 extending through the aforesaid machine to fill capsules 3.

The conveyor 17 is wound in a ring shape around a plurality of sprockets 18 (only the sprocket 18 obtained on the drum 5 is shown in FIG. 1) and is provided with a plurality of pockets 19, which are substantially cup-shaped with the concavity facing upwards, are uniformly distributed along the conveyor 17, and are designed to each house a respective bottom 4 arranged inside the relative pocket 19 with its concavity facing upwards.

The feeding assembly 1 comprises, furthermore, a hopper 20 containing the granules 2.

The hopper 20 is cup-shaped with the concavity facing upwards and extends around a longitudinal axis 21 of its own, which is parallel to and distinct from the aforesaid axis 6.

The hopper 20 is delimited by a bottom wall 22 substantially perpendicular to the axis 21 and is provided with a feeding track 23, which is wound in a helical shape around and along the aforesaid axis 21 starting from the wall 22, so as to feed the granules 2, in succession, to a transfer station 24 to transfer the granules 2 to the fillers 8.

The hopper 20 is fixed to a vibrating base (not shown), which is designed to cause the hopper 20 to vibrate according to a given law, so as to feed the granules 2 along the track 23 in a single layer of granules 2.

In the area of the station 24, the track 23 has a radial width decreasing in the feeding direction of the granules 2 and radially faces, on one side, the wall 22 and, on the other side, a cavity 25, which is obtained on an upper edge of the hopper 20 and extends around the axis 21.

The vibrations of the hopper 20, the decreasing radial width of the track 23, and the presence of the cavity 25 allow each filler 8 to directly pick up, in the area of the station 24, a correct quantity of granules 2, thus avoiding the scraping of the pipes 9 and the recirculation of the excess granules 2 inside the hopper 20.

In use, the fillers 8 are fed by the drum 5 around the axis 6, along a path P closed in a ring shape around the axis 6 itself, each in phase with a respective pocket 19 of the conveyor 17.

In the area of a first portion of the path P extending above the hopper 20, each filler 8 is lowered by the cam operating device 15 on the track 23 and is connected to the aforesaid pneumatic sucking device (not shown) so as to pick up the granules 2 from the track 23.

The suction generated in the pipe 9 allows the thin plate 13 to hold back the granules 2 picked up from the track 23, thus preventing them from getting into the pipe 9.

In the area of a second portion of the path P extending on the outside of the hopper 20, each filler 8 is lowered by the device 15 on the relative bottom 4 and is disconnected from the aforesaid pneumatic sucking device (not shown) so as to release the granules 2 into the bottom 4.

Figure 4:
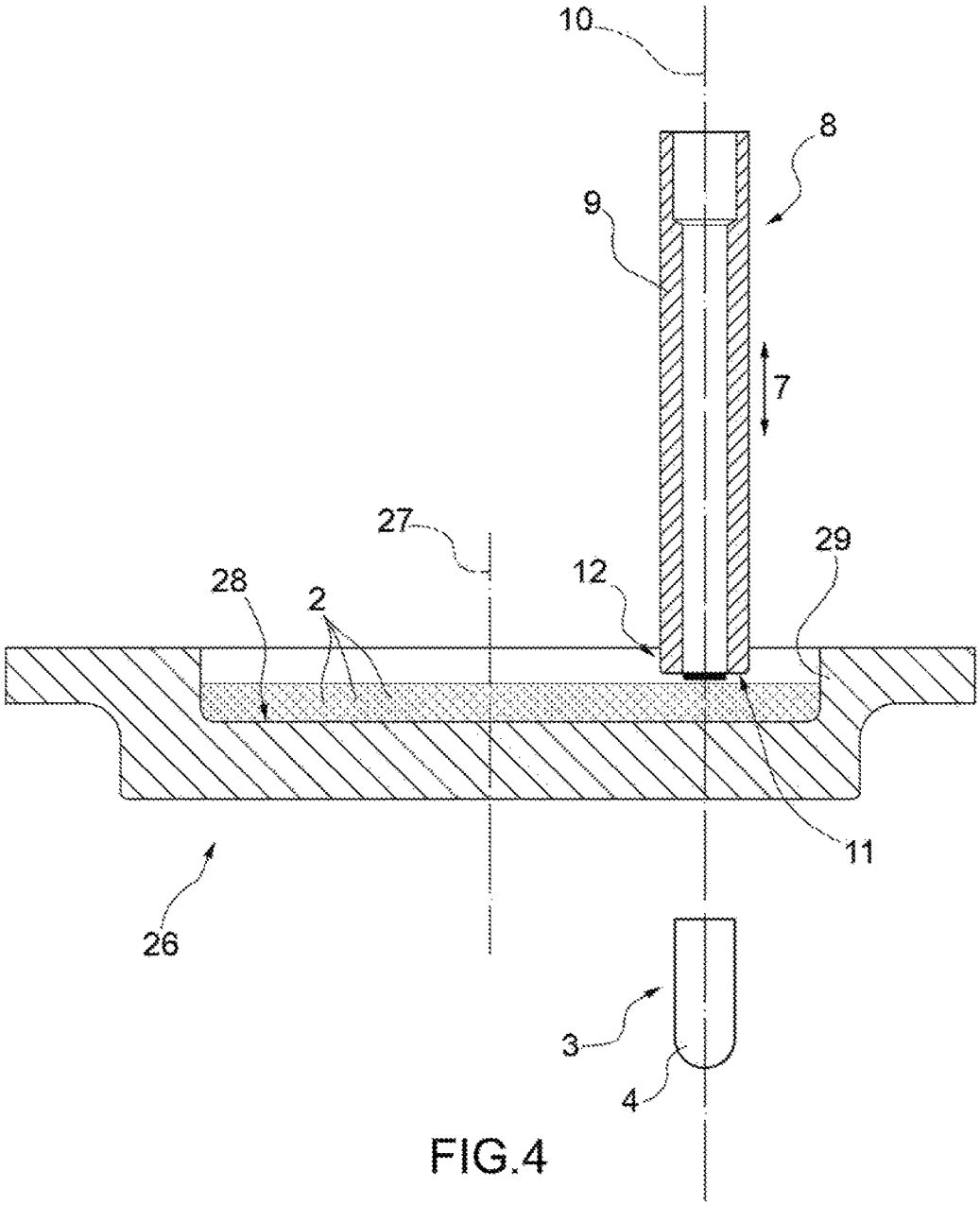
FIG. 4 is a schematic side view, with cross-sectional parts and parts removed for greater clarity, of a variant of the feeding assembly of FIG. 1.

The difference between the variant shown in FIG. 4 and the previous figures lies in the sole fact that the hopper 20 is eliminated and replaced by a hopper 26, which has a longitudinal axis 27 parallel to and distinct from the axis 6, is delimited by a bottom wall 28 substantially perpendicular to the axis 27, and is further delimited by a side wall 29 substantially coaxial to the axis 27.

In this case, each filler 8 is firstly lowered into the hopper 26 so as to pick up and hold back, by means of the respective thin plate 13, one single layer of granules 2, then it is lifted so as to disengage the hopper 26, and it is finally lowered again on the relative bottom 4 so as to release the granules 2 into the bottom 4.

The hopper 26 can be mounted so as to rotate around the axis 27 or it can be fixed to a vibrating base (not shown), which is designed to cause the hopper 26 to vibrate according to a given law.

According to a variant that is not shown herein, the feeding assembly 1 comprises an intermediate disc, which is fitted between the drum 5 and the conveyor 17 so as to rotate around the axis 6.

The intermediate disc is provided with a plurality of pockets, which are uniformly distributed around the axis 6 at the same distribution distance as the fillers 8, are each aligned with a respective pipe 9 and with a respective pocket 19 in the direction 7, and are axially open in the direction 7.

Each pocket is laterally delimited by a cylindrical bushing, which is designed to receive and hold a relative bottom 4, which is transferred between the conveyor 17 and the intermediate disc in a known manner.

The bushing carries, integrated in it, a capacitive transducer, which defines, together with the capacitive transducers of the other bushings, part of a weighing system comprising, furthermore, a processing unit connected to the capacitive transducers.

The bushings and the capacitive transducers are described and shown in patent application no. WO-2006/035285-A2 filed by the Applicant, whose content is entirely included in this patent application.

The weighing system allows to measure the weight of each bottom 4 upstream of the station 24 and the total weight of each bottom 4 and of the relative granules 2 downstream of the station 24.

The invention claimed is:

1. A feeding assembly to fill capsules (3) with granules (2), each capsule (3) comprising a respective bottom (4) and a lid to close the bottom (4), the feeding assembly comprising a filling drum (5), which is mounted so as to continuously rotate around a rotation axis (6), and is provided with a plurality of fillers (8) distributed around the rotation axis (6); and a hopper (20; 26) containing the granules (2); each filler (8) comprising a suction pipe (9), which can be connected to a pneumatic sucking device, is coupled to the filling drum (5) so as to carry out, relative to the filling drum (5), straight movements parallel to the rotation axis (6), and has a lower end (12) to pick up/release the granules (2); and being characterized in that the lower end (12) of each suction pipe (9) is closed by a closing element (13) provided with a plurality of openings (14), each designed so as to prevent the granules (2) from getting into the suction pipe (9);

wherein the hopper (20; 26) has a longitudinal axis (21; 27), which is parallel to and distinct from said rotation axis (6); and wherein the hopper (20) comprises a vibrating distribution plate provided with a feeding track (23), which is wound in a helical shape around and along said longitudinal axis (21), so as to feed the granules (2), in succession, to a transfer station (24) to transfer the granules (2) to the fillers (8).

2. A feeding assembly according to claim 1, wherein the fillers (8) are movable along a feeding path (P), which is closed in a ring shape around the rotation axis (6) and only partly extends above the hopper (20; 26).

3. A feeding assembly according to claim 1, wherein the lower end (12) of each suction pipe (9) is axially delimited by an end face (11), to which the relative closing element (13) is fixed.

4. A feeding assembly according to claim 1, wherein the closing element (13) comprises a thin plate, which is fixed to an end face (11) of the lower end (12) of the suction pipe (9) and is provided with said openings (14).

5. A feeding assembly according to claim 1, wherein, in the area of the transfer station (24), the feeding track (23) extends between two side cavities (22, 25) provided on opposite sides of the feeding track (23) itself.

6. A feeding assembly according to claim 1, wherein said openings (14) are distributed inside an area with a circular shape.

7. A feeding assembly according to claim 1, wherein said openings (14) are distributed inside an area with an elongated shape.

8. A feeding assembly according to claim 1 and comprising, furthermore, for each filler (8), a respective pocket mounted under the filler (8) so as to receive and hold a bottom (4); the pocket being provided with a measuring device to measure both the weight of the bottom (4) and the weight of the bottom (4) and of the granules (2) contained in the bottom (4).

9. A feeding assembly according to claim 8 and comprising, furthermore, a conveyor device (17) to feed each bottom (4) around said rotation axis (6) in phase with a relative filler (8).

10. A feeding assembly to fill capsules (3) with granules (2), each capsule (3) comprising a respective bottom (4) and a lid to close the bottom (4), the feeding assembly comprising a filling drum (5), which is mounted so as to continuously rotate around a rotation axis (6), and is provided with a plurality of fillers (8) distributed around the rotation axis (6); and a hopper (20; 26) containing the granules (2); each filler (8) comprising a single suction pipe (9), which can be connected to a pneumatic sucking device and is coupled to the filling drum (5) so as to carry out, relative to the filling drum (5), straight movements parallel to the rotation axis (6), and has a lower end (12) to pick up/release the granules (2); and being characterized in that the lower end (12) of each suction pipe (9) is closed by a closing element (13) provided with a plurality of openings (14), each designed so as to prevent the granules (2) from getting into the suction pipe (9), comprising, for each filler (8), a respective pocket mounted under the filler (8) so as to receive and hold a bottom (4); the pocket being provided with a measuring device to measure both the weight of the bottom (4) and the weight of the bottom (4) and of the granules (2) contained in the bottom (4), and further comprising a conveyor device (17) to feed each bottom (4) around said rotation axis (6) in phase with a relative filler (8).

11. A feeding assembly according to claim 10, wherein the hopper (20; 26) has a longitudinal axis (21; 27), which is parallel to and distinct from said rotation axis (6).

12. A feeding assembly according to claim 11, wherein the hopper (20) comprises a vibrating distribution plate provided with a feeding track (23), which is wound in a helical shape around and along said longitudinal axis (21), so as to feed the granules (2), in succession, to a transfer station (24) to transfer the granules (2) to the fillers (8).

13. A feeding assembly according to claim 10, wherein the fillers (8) are movable along a feeding path (P), which is closed in a ring shape around the rotation axis (6) and only partly extends above the hopper (20; 26).

14. A feeding assembly according to claim 10, wherein the lower end (12) of each suction pipe (9) is axially delimited by an end face (11), to which the relative closing element (13) is fixed.

15. A feeding assembly according to claim 10, wherein the closing element (13) comprises a thin plate, which is fixed to an end face (11) of the lower end (12) of the suction pipe (9) and is provided with said openings (14).

16. A feeding assembly according to claim 10, wherein said openings (14) are distributed inside an area with a circular shape.

17. A feeding assembly according to claim 10, wherein said openings (14) are distributed inside an area with an elongated shape.

18. A feeding assembly to fill capsules (3) with granules (2), each capsule (3) comprising a respective bottom (4) and a lid to close the bottom (4), the feeding assembly comprising a filling drum (5), which is mounted so as to continuously rotate around a rotation axis (6), and is provided with a plurality of fillers (8) distributed around the rotation axis (6); and a hopper (20; 26) containing the granules (2); each filler (8) comprising a single suction pipe (9), which can be connected to a pneumatic sucking device and is coupled to the filling drum (5) so as to carry out, relative to the filling drum (5), straight movements parallel to the rotation axis (6), and has a lower end (12) to pick up/release the granules (2); and being characterized in that the lower end (12) of each suction pipe (9) is closed by a closing element (13) provided with a plurality of openings (14), each designed so as to prevent the granules (2) from getting into the suction pipe (9), wherein the fillers (8) are movable along a feeding path (P), which is closed in a ring shape around the rotation axis (6) and only partly extends above the hopper (20; 26);

wherein the lower end (12) of each suction pipe (9) is axially delimited by an end face (11), to which the relative closing element (13) is fixed; and wherein each filler (8) is movable parallel to the rotation axis (6) and is lowered firstly on the hopper (20; 26) so as to pick up the granules (2) from the hopper (20; 26) and finally on the relative bottom (4) so as to release the granules (2) into the bottom (4).

19. A feeding assembly according to claim 18, wherein the closing element (13) comprises a thin plate, which is fixed to an end face (11) of the lower end (12) of the suction pipe (9) and is provided with said openings (14).

20. A feeding assembly according to claim 18, wherein the hopper (20; 26) has a longitudinal axis (21; 27), which is parallel to and distinct from said rotation axis (6).

* * * * *